US006489859B1

(12) United States Patent
Tahara et al.

(10) Patent No.: US 6,489,859 B1
(45) Date of Patent: Dec. 3, 2002

(54) POWER DIVIDER/COMBINER

(75) Inventors: Yukihiro Tahara, Tokyo (JP); Hideyuki Oh-Hashi, Tokyo (JP); Moriyasu Miyazaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/502,786

(22) Filed: Feb. 11, 2000

(30) Foreign Application Priority Data

Apr. 16, 1999 (JP) ..... 11-109628

(51) Int. Cl.[7] ..... H01P 5/12; H01P 3/08

(52) U.S. Cl. ..... 333/124; 333/120; 333/125; 333/128; 333/136

(58) Field of Search ..... 333/124, 120, 333/125, 128, 136

(56) References Cited

U.S. PATENT DOCUMENTS

| | | | | |
|---|---|---|---|---|
| 4,310,814 A | * | 1/1982 | Bowman | 333/128 |
| 4,401,955 A | * | 8/1983 | Yorinks et al. | 333/136 |
| 5,634,208 A | * | 5/1997 | Nishikawa et al. | 333/120 |

FOREIGN PATENT DOCUMENTS

| | | |
|---|---|---|
| JP | 57181204 | 11/1982 |
| JP | 738309 | 2/1995 |
| JP | 07038309 | 2/1995 |
| JP | 09321509 | 12/1997 |

OTHER PUBLICATIONS

R. E. Collin, Foundations for Microwave Engineering, 2nd Edition, pp. 442–450, 1992.

Japanese Abstract 56058310 published May 21, 1981.

Sean R. Mercer, Ph.D., "Linear Simulators Offer Successful Microstrip Modeling For Wilkinson Power–Splitters", RF Design, Cardiff Publishing Co., Englewood, Co. US, vol. 19, No. 9, Sep. 1, 1996 pp. 38, 42, 45–46 and 48.

Maurin, et al., "Microstrip Three–Way Power Combiners Using A Standard MIC Technology", Proceedings of the 26$^{th}$, Prague, Sep. 9–13, 1996, Proceedings of the European Microwave Conference, Swanley, Nexus–Media, GB, vol. 2, Conf. 26, Sep. 9, 1996, p. 839–843.

* cited by examiner

*Primary Examiner*—Patricia Nguyen

(74) *Attorney, Agent, or Firm*—Birch, Stewart, Kolasch & Birch, LLP

(57) ABSTRACT

The prior art has a problem in which an isolation between output terminals is deteriorated when a thin film resistor is used as an isolation resistor. Such being the case, in a power divider/combiner comprising an input terminal, two output terminals, two branch lines each connecting the input terminal and one of the output terminals and having a line length that is ¼ of a set wavelength or a multiple of integer of half a wavelength and ¼ of the set wavelength, and an isolation resistor connected to between the output terminals, there is provided an improved power divider/combiner further comprising a transmission line interposed between each of the output terminals and the branch lines. Consequently, even when using the isolation resistor having a length that can not be ignored as compared with a wavelength of a high-frequency signal in use, the isolation between the output terminals can be ensured.

8 Claims, 8 Drawing Sheets

POWER DIVIDER/COMBINER

BACKGROUND OF THE INVENTION

1. Field of the Invention

The present invention relates to a power diver/combiner for dividing or combining mainly high-frequency signals in a microwave band and a millimeter-wave band.

2. Description of the Related Art

A conventional power divider/combiner will be described with reference to the drawings. FIG. 11 is a diagram showing a circuit configuration of the conventional power divider/combiner reported in, e.g., "Foundations for Microwave Engineering Second Edition," written by R. E. Collin, McGraw-Hill International Editions Electrical Engineering Series, p445, McGraw-Hill Inc., 1992.

Referring to FIG. 11, there are shown an input line 10, output terminals 2, a branch line 3 with an electrical length being a ¼ wavelength, of which one end is connected at a diverging point 31 to the input line 10 and the other ends are connected to the output terminals 2, an isolation resistor 5 connected to between the output terminals 2, and load impedances 21 connected to the output terminals 2.

Next, an operation of the conventional power divider/combiner explained above will be described with reference to the drawings. FIG. 12 is a diagram showing how the prior art power divider/combiner operates.

The high-frequency signal inputted to the input line 10 is divided at the diverging point 31 to the branch lines 3. The signals assuming the same phase and having an equal amplitude flow to the output terminals 2 which are therefore take an equal electric potential, while no current flows to the isolation resistor 5.

At that time, the branch lines 3 function as a ¼ wavelength impedance transformer, whereby an impedance as viewed from the input line 10 toward the output terminals 2 side is equal to a characteristic impedance of the input line 10, and the high-frequency signal is divided without causing any reflection.

On the other hand, the high-frequency signals, when inputted to the output terminals 2, are combined at the diverging point 31 and thus outputted to the input line 10.

Further, even when there is a difference in potential between the output terminals 2, as shown in FIG. 12, a high-frequency signal A (¼+¼=½ wavelength delay) flowing through one of the branch lines 3 from one of output terminals 2 and a high-frequency signal B (with no delay) flowing to the isolation resistor 5, become opposite in phase and equal in amplitude at the other output terminal 2, and are therefore offset each other. As a result, the current flows to the isolation resistor 5 and is absorbed, and the isolation between the output terminals 2 is ensured.

In the conventional Wilkinson type power divider/combiner described above, a passing phase of the isolation resistor 5 is required to be zero in order to ensure the isolation between the output terminals 2. If a thin film resistor is used as the isolation resistor 5, however, a length of the resistor can not be ignored as compared with the wavelength of the high-frequency signal, and the high-frequency signals A, B shown in FIG. 12 do not assume the opposite phases. Therefore, the signal inputted to one of output terminals 2 is not offset at the other output terminal 2, and there arises a problem in that the isolation between the output terminals 2 declines.

Further, when viewed from the input terminal 10, the isolation resistor 5 having the electrical length appears as a open stub, and hence there also exists such a problem that an I/O reflection characteristic declines.

SUMMARY OF THE INVENTION

It is a primary object of the present invention, which was devised to obviate the problem described above, to provide a power divider/combiner capable of ensuring an isolation between output terminals even with using of an isolation resistor having a length that can not be ignored as compared with a wavelength of a high-frequency signal in use, and exhibiting an excellent I/O reflection characteristics.

To accomplish the above object, according to a first aspect of the present invention, there is provided a power divider/combiner comprising an input terminal; two output terminals, two branch lines each connecting the input terminal and the output terminal and having a line length that is ¼ of a set wavelength or a multiple of integer of half a wavelength and ¼ of the set wavelength, an isolation resistor connected to between the output terminals, and a transmission line interposed between each of the output terminals and the branch lines.

The power divider/combiner according to a second aspect of the present invention may further comprise a capacitance element having one end connected to the input terminal and the other end grounded.

The power divider/combiner according to a third aspect of the present invention may further comprise a open stub connected to the input terminal.

The power divider/combiner according to a fourth aspect of the present invention may further comprise a low impedance line interposed between the input terminal and a connecting point between the two branch lines.

In the power divider/combiner according to a fifth aspect of the present invention, the isolation resistor may be connected between the output terminals through a connection line.

According to a sixth aspect of the present invention, there is provided a 2-way power divider/combiner constructed by connecting at multi-stages the 2-way power dividers/combiners according to the second through fifth aspects of the invention, wherein the 2-way power dividers/combiners disposed at the second stage onward are provided with neither the capacitance element, nor the open stub, nor the low impedance line.

DESCRIPTION OF THE PREFERRED EMBODIMENTS

Embodiment 1

Figure 1:
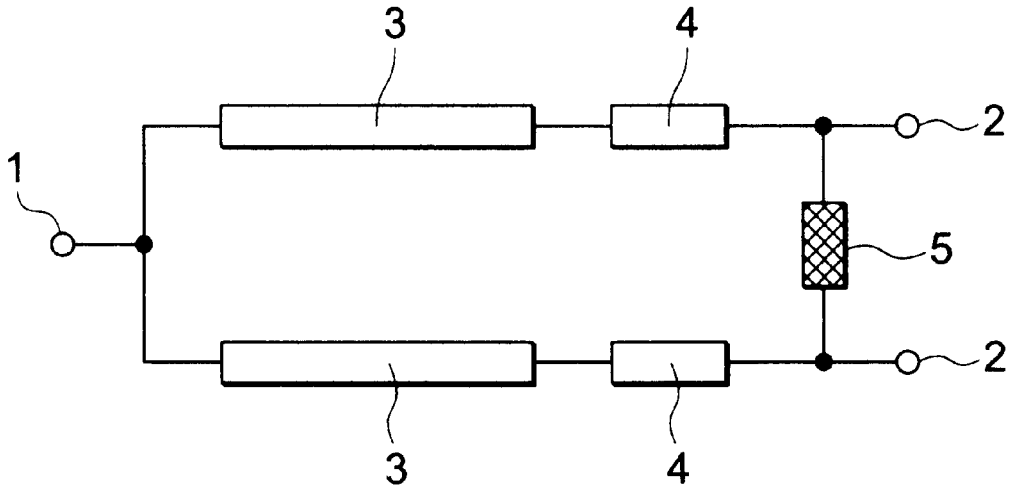
FIG. 1 is a diagram showing a circuit configuration of a power divider/combiner in accordance with an embodiment 1 of the present invention.

A power divider/combiner in accordance with an embodiment 1 of the present invention will hereinafter be described with reference to the accompanying drawings. FIG. 1 is a diagram showing a circuit configuration of the power divider/combiner in accordance with the embodiment 1 of the present invention. Note that the same numerals designate the same or corresponding components throughout the drawings.

Referring first to FIG. 1, there are shown an input terminal 1, output terminals 2, branch lines 3 of which an electrical length for dividing a high-frequency signal inputted from the input terminal 1 is a ¼ wavelength or an integer multiple of ½ wavelength plus ¼ wavelength, transmission lines 4 with an electrical length being shorter than the ¼ wavelength, of which one ends are connected to the branch lines 3 and the other ends are connected to the output terminals 2, and an isolation resistor 5 having a finite electrical length and connected to between the output terminals 2.

Figure 2:
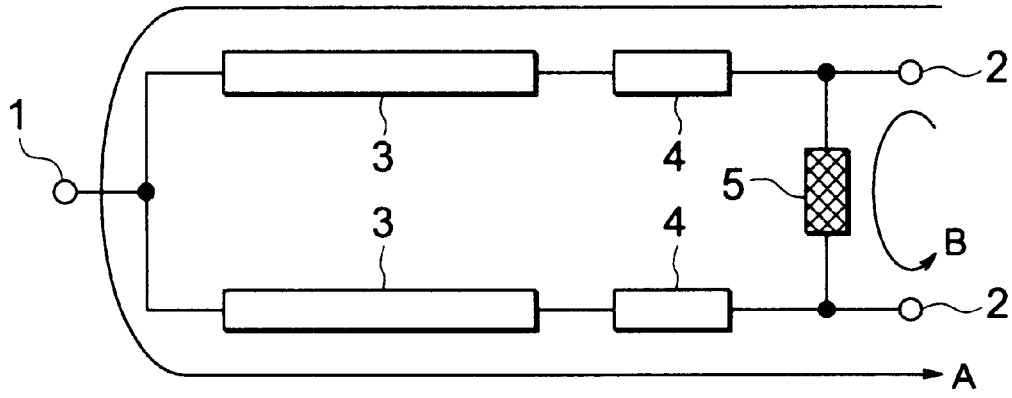
FIG. 2 is a diagram showing an operation of the power divider/combiner in accordance with the embodiment 1 of the present invention.

Next, an operation of the power divider/combiner in the embodiment 1 will be explained referring to the drawings. FIG. 2 is a diagram showing how the power divider/combiner in the embodiment 1 of the present invention operates.

In this power divider/combiner, when high-frequency signals having a difference in potential are inputted to the output terminals 2, the electrical length of the transmission lines 4 are selectively set to a proper value. As shown in FIG. 2, a high-frequency signal A flowing through the branch lines 3 from one output terminal 2 and a high-frequency signal B flowing to the isolation resistor 5, can be thereby made to assume opposite phases at the other output terminal 2. Therefore, even when the isolation resistor 5 has an electrical length, there is an effect in which an isolation between the output terminals increases.

Embodiment 2

The embodiment 1 discussed above exhibits the effect that the isolation between the output terminals increases owing to a function of the transmission lines 4, but still presents such a problem that a reflection as viewed from the input terminal 1 is not improved. This is because the resistor 5 having the electrical length functions as a open stub with respect to the line of the signal flowing from the input terminal 1 to the output terminals 2.

Figure 3:
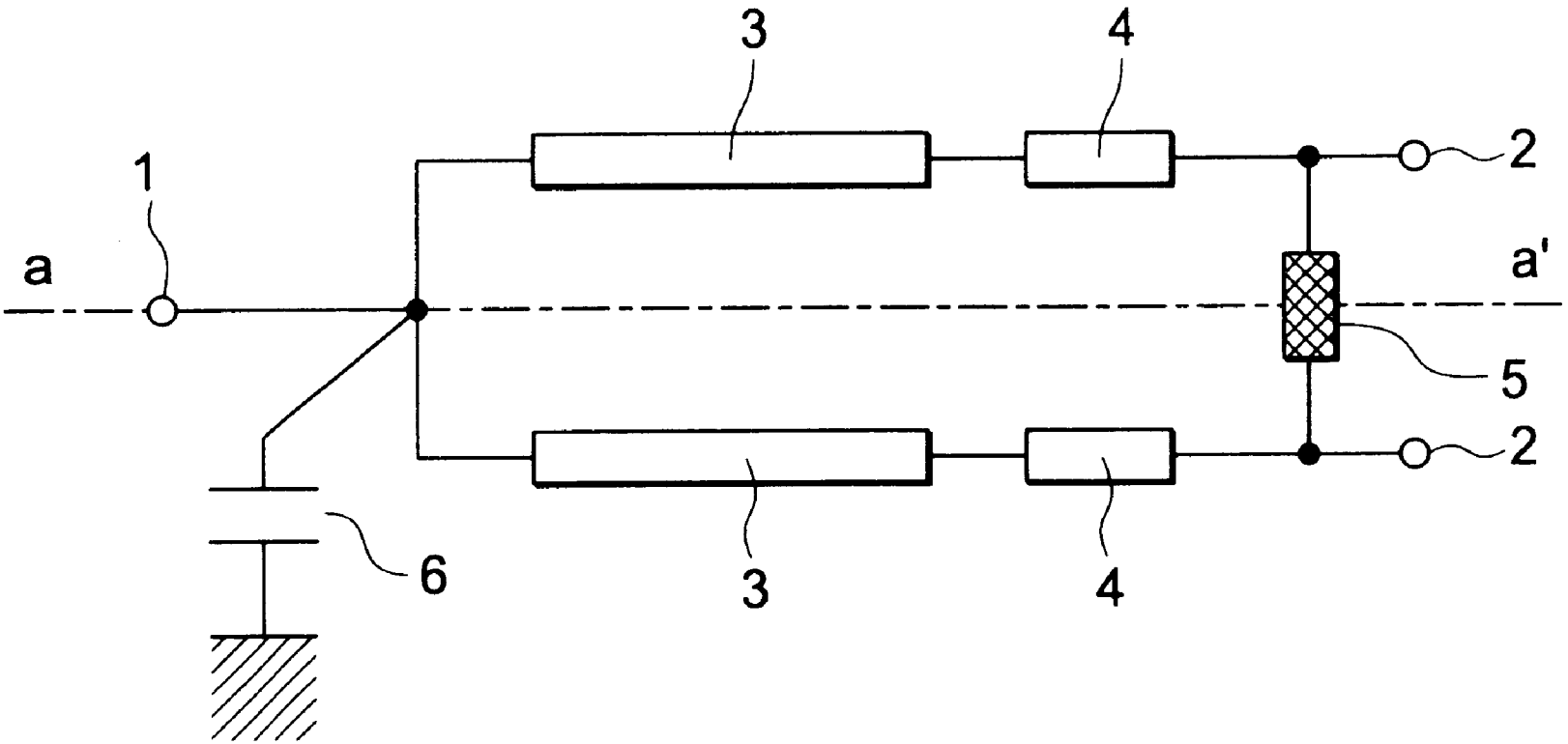
FIG. 3 is a diagram showing a circuit configuration of the power divider/combiner in accordance with an embodiment 2 of the present invention.

The power divider/combiner in accordance with the embodiment 2 of the present invention will hereinafter be described with reference to the accompanying drawings. FIG. 3 is a diagram showing a circuit configuration of the power divider/combiner in the embodiment 2 of the present invention.

Referring to FIG. 3, there are shown the input terminal 1, the output terminals 2, the branch lines 3 of which the electrical length for dividing the high-frequency signal inputted from the input terminal 1 is the ¼ wavelength or an integer multiple of ½ wavelength plus ¼ wavelength, the transmission lines 4 with the electrical length being shorter than the ¼ wavelength, of which one ends are connected to the branch lines 3 and the other ends are connected to the output terminals 2, the isolation resistor 5 having the finite electrical length and connected to between the output terminals 2, and a capacitor 6 of which one end is connected to the input terminal 1 and the other end is grounded.

In this power divider/combiner, when the high-frequency signal is inputted to the input terminal 1, a plane a—a' in FIG. 3 can be assumed to be a magnetic wall.

Figure 4:
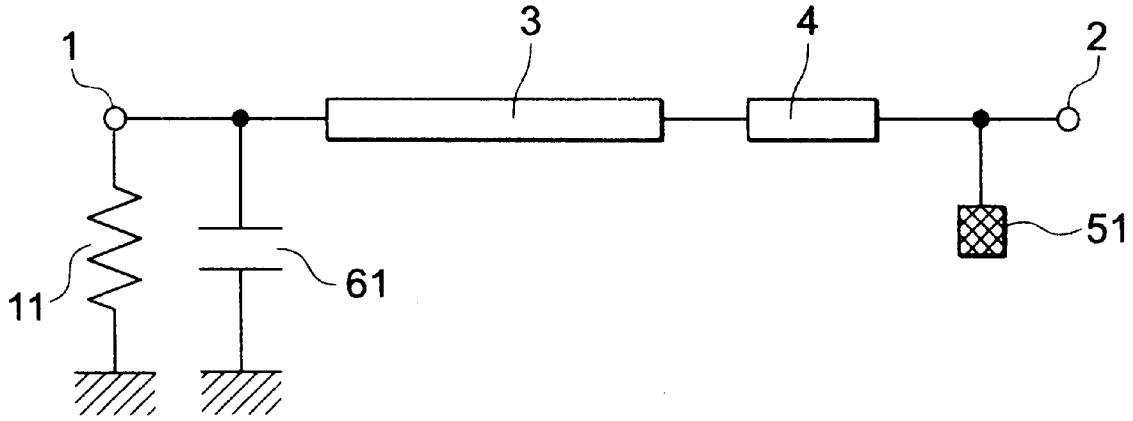
FIG. 4 is a diagram showing an equivalent circuit of the power divider/combiner in accordance with the embodiment 2 of the present invention.

A reflection as viewed from the input terminal 1 in that case is equivalent to a reflection of the circuit shown in FIG. 4. Referring to FIG. 4, a load designated by 11 is connected to the input terminal 1 from outside, and a resistor denoted by 51 has an electrical length that is the half of the electrical of the isolation resistor 5 in FIG. 3, and one end thereof is connected to the output terminal 2 while the other end thereof is unconnected. Further, a capacitor designated by 61 has a capacitance that is the half of the capacitance of the capacitor 6 in FIG. 3, and one end thereof is connected to the input terminal 1 while the other end thereof is grounded.

The resistor 51 has the electrical length and therefore, as described above, functions as a open stub with respect to the line of the signal flowing to the output terminal 2 via the branch line 3 from the input terminal. A susceptance possessed by the resistor 51 is compensated by the capacitor 61. Hence, there is an effect in which a reflection characteristic as viewed from the input terminal 1 is ameliorated.

Embodiment 3

Figure 5:
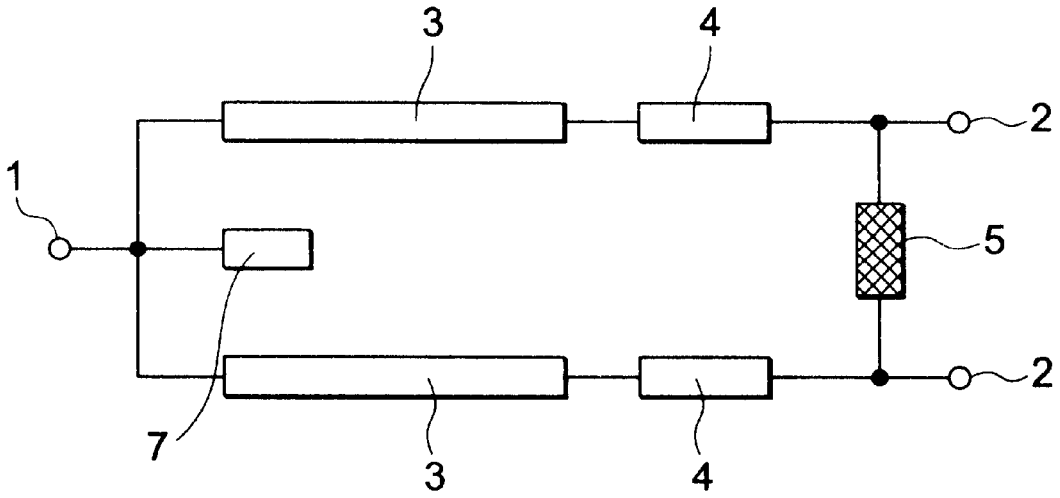
FIG. 5 is a diagram showing a circuit configuration of the power divider/combiner in accordance with an embodiment 3 of the present invention.

In accordance with the embodiment 2 discussed above, the capacitor 6, of which the other end is grounded, is connected to the input terminal 1, however, a open stub 7 may be connected as illustrated in FIG. 5. With this configuration, the same effects as those in the embodiment 2 are obtained. A further effect is that the circuit can be configured on the plane.

Embodiment 4

Figure 6:
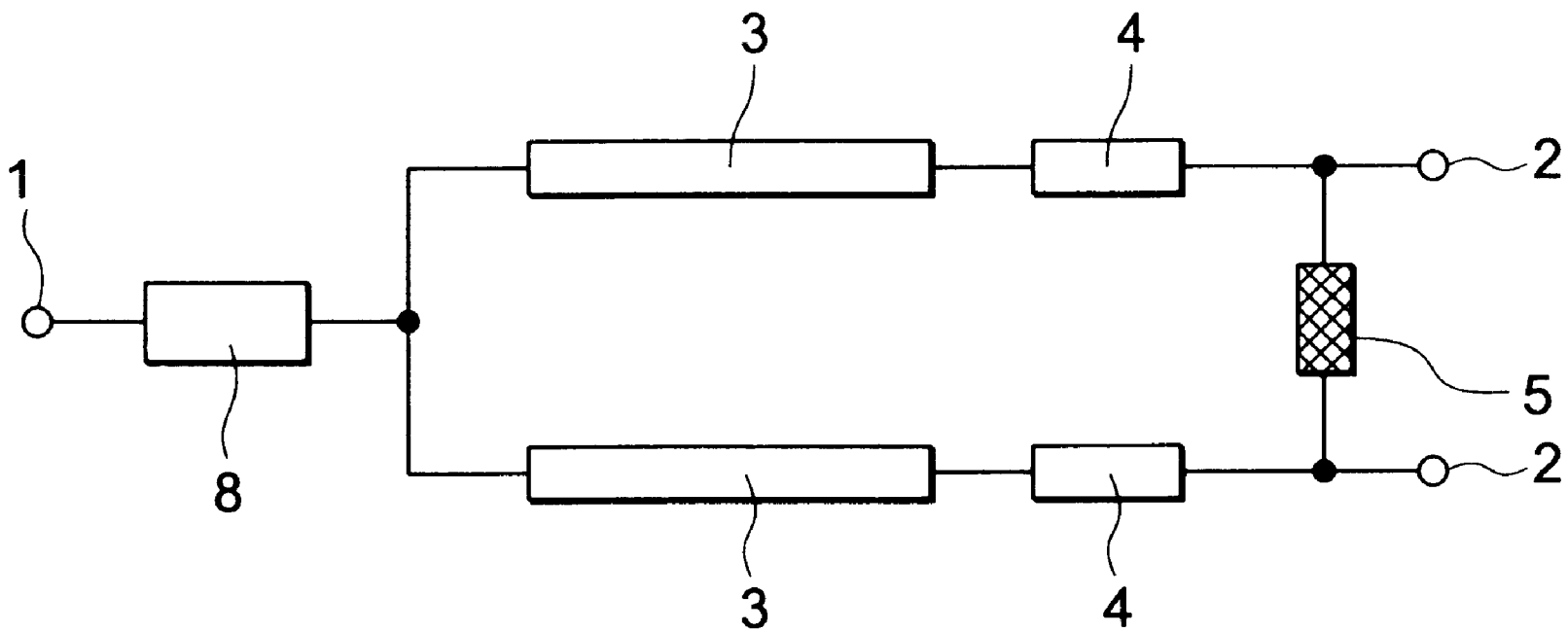
FIG. 6 is a diagram showing a circuit configuration of the power divider/combiner in accordance with an embodiment 4 of the present invention.

Further, a low impedance line 8 may be, as shown in FIG. 6, interposed between the input terminal 1 and a connecting point between the branch lines 3. With this configuration, the same effects as those in the embodiment 2 are also obtained. Moreover, there is no necessity for a space for providing the capacitor and the open stub, and hence there is such an effect that the circuit can be downsized.

Embodiment 5

Figure 7:
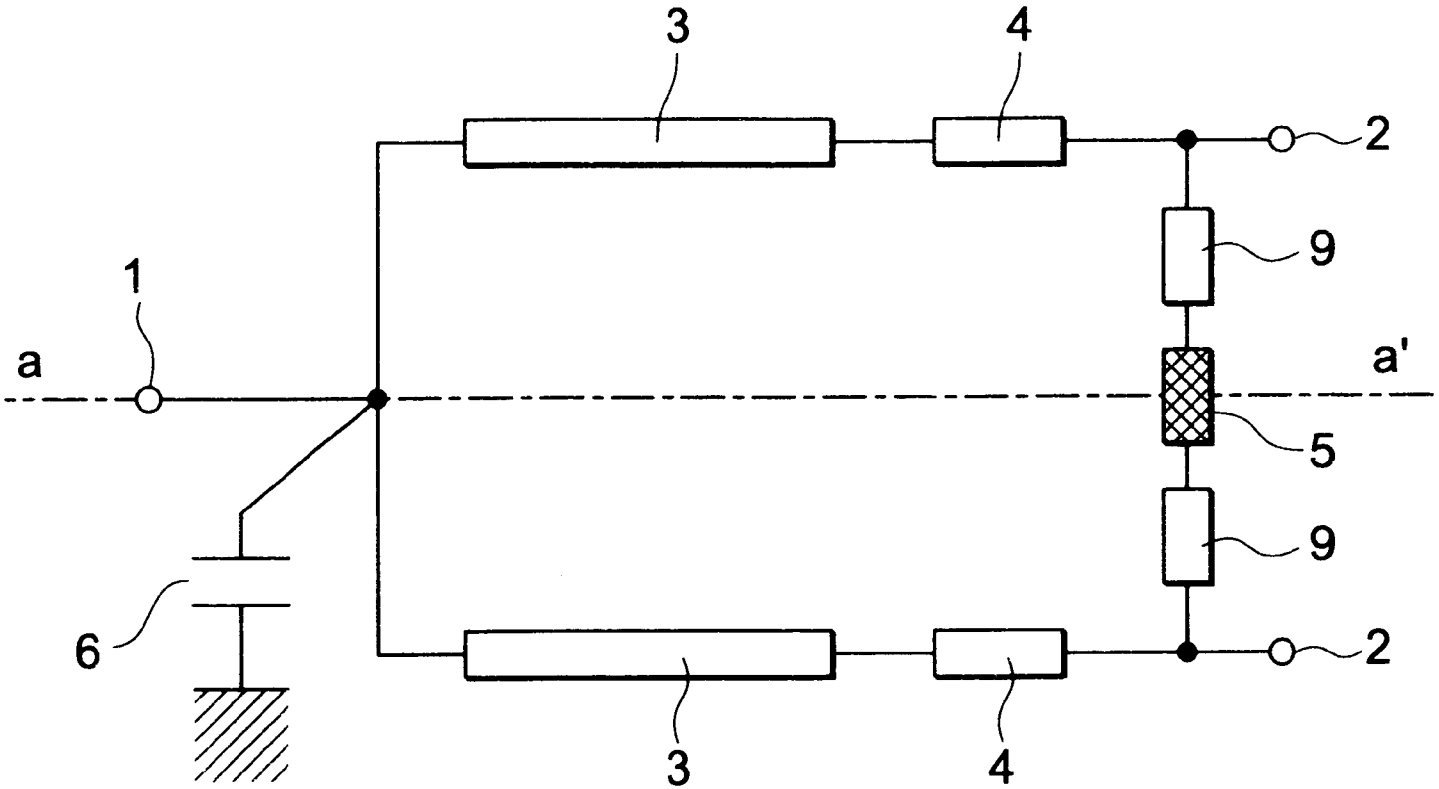
FIG. 7 is a diagram showing a circuit configuration of the power divider/combiner in accordance with an embodiment 5 of the present invention.

FIG. 7 is a diagram showing a circuit configuration of the power divider/combiner in an embodiment 5 of the present invention.

Referring to FIG. 7, there are shown the input terminal 1, the output terminals 2, the branch lines 3 of which the electrical length for dividing the high-frequency signal inputted from the input terminal 1 is the ¼ wavelength or an integer multiple of ½ wavelength plus ¼ wavelength, the transmission lines 4 with the electrical length being shorter than the ¼ wavelength, of which one ends are connected to the branch lines 3 and the other ends are connected to the output terminals 2, the isolation resistor 5 having the finite electrical length and connected to between the output terminals 2, the capacitor 6 of which one end is connected to the input terminal 1 and the other end is grounded, and connection lines 9 serve to connect the output terminals 2 to the isolation resistor 5.

In this power divider/combiner, a high-frequency signal assuming an arbitrary amplitude phase, which is inputted to the output terminals 2, can be expressed as an overlap of an odd mode of inputting a signal having an opposite phase equal amplitude with an even mode of inputting a signal having an in-phase equal amplitude.

Figure 8:
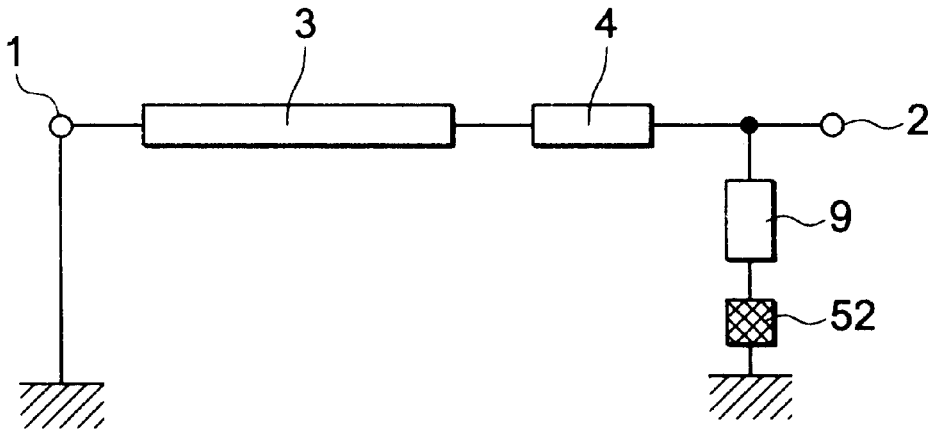
FIG. 8 is a diagram showing an equivalent circuit of the power divider/combiner in accordance with the embodiment 5 of the present invention.

When the high-frequency signal having the opposite equal amplitude is inputted to the output terminals 2 (the odd mode), a plane a—a' in FIG. 7 can be assumed as an electric wall. FIG. 8 illustrates an equivalent circuit of the power divider/combiner in that case. Referring to FIG. 8, the numeral 52 represents a resistor having an electrical length that is the half of the electrical length of the isolation resistor 5 in FIG. 7, of which one end is connected to the connection line 9 and the other end is grounded.

According to "A Tapered Line Broadband Power Divider Using Plural Strip Isolation Resistors," written by Oh-hashi, Yukawa and Miyazaki, the IEICE Technical Report, MW96-215, 1997, an admittance Yro of a strip-shaped resistor with one end being grounded, is given by the following formula (1):

$$Y_{ro} = \frac{1}{Z_{ro}} = \frac{1}{Z_r \tanh(\gamma \cdot g_r/2)} \qquad \text{Formula (1)}$$

However, $Z_r$ and $\gamma$ are expressed by the following formula (2):

$$Z_r = \sqrt{\frac{R_r + j\omega L_r}{j\omega C_r}} \qquad \text{Formula (2)}$$

$$\gamma = \sqrt{(R_r + j\omega L_r)\cdot j\omega C_r} \text{ and,}$$

$$R_r = \frac{R_s}{W_r}$$

$$L_r = \frac{\sqrt{\varepsilon_r Z_s}}{c}$$

$$C_r = \frac{\sqrt{\varepsilon_r}}{cZ_s}$$

where $Z_s$ is the characteristic impedance of the line having the same line width $W_r$ as that of the strip-shaped resistor, c is the light velocity, $\epsilon_r$ is the dielectric constant of the substrate, $R_s$ is the resistivity in Ohms/squares value of the isolation resistor 5, ω is the angular frequency of the signal, and $g_r$ is the length of the isolation resistor 5.

Further, the branch line 3 has the electrical length that is the ¼ wavelength or an integer multiple of ½ wavelength plus ¼ wavelength, and one end thereof is connected to the transmission line 4, while the other end thereof is grounded. It may therefore be conceived to be open at a connecting point between the branch line 3 and the transmission line 4. Accordingly, it follows that the transmission line 4 functions as a open stub with respect to the line of the signal flowing to the resistor 52 from the output terminal 2. Herein, characteristic impedances $Z_1$, $Z_2$ and line lengths $\theta_1$, $\theta_2$ of the connection line 9 and the transmission line 4 functioning as the open stub, are set as in the following formula (3) so as to make matching between the impedance $Z_{ro}$ possessed by the resistor 52 and the impedance $Z_{od}$ connected to the output terminal 2 from outside, in which case all the high-frequency signals inputted to the output terminals 2 are absorbed by the resistor 52 without being reflected.

$$\frac{1}{Z_{od}} = Re\left[\frac{1}{Z_1}\cdot\frac{Z_1 + jZ_{ro}\tan\theta_1}{Z_{ro} + jZ_1\tan\theta_1}\right] \operatorname{Im}\left[\frac{1}{Z_1}\cdot\frac{Z_1 + jZ_{ro}\tan\theta_1}{Z_{ro} + jZ_1\tan\theta_1}\right] + \frac{\tan\theta_2}{Z_2} = 0 \qquad \text{Formula (3)}$$

On the other hand, when the high-frequency signal having the in-phase equal amplitude is inputted to the output terminal 2 (the even mode), the plane a—a' in FIG. 7 can be assumed as the magnetic wall.

Figure 9:
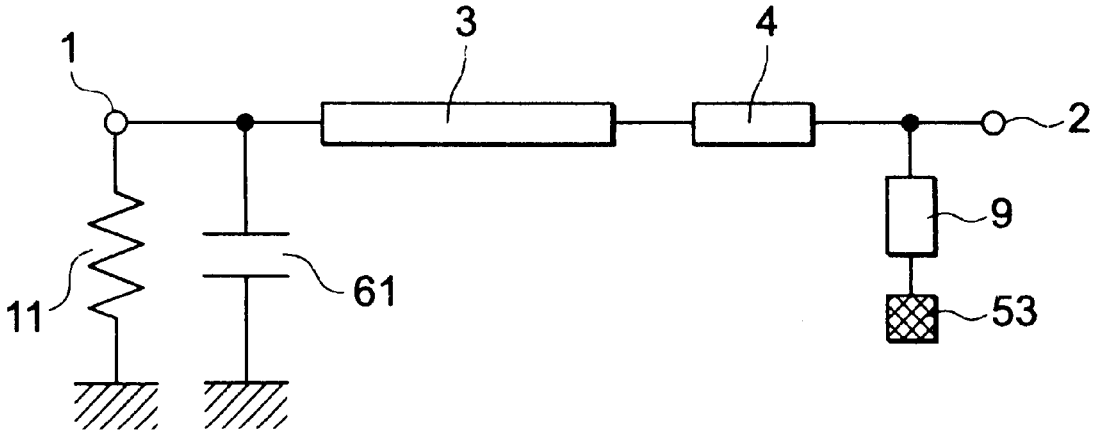
FIG. 9 is a diagram showing an equivalent circuit of the power divider/combiner in accordance with the embodiment 5 of the present invention.

FIG. 9 illustrates an equivalent circuit of the power divider/combiner in that case. Referring to FIG. 9, the numeral 53 stands for a resistor having an electrical length that is the half of the electrical length of the isolation resistor 5 in FIG. 7, of which one end is connected to the connection line 9 and the other end is open.

According to the above-mentioned literature by Oh-hashi, an admittance $Y_{re}$ of a strip-shaped resistor with one end being open, is given by the following formula (4):

$$Y_{re} = \frac{1}{Z_{re}} = \frac{\tanh(\gamma \cdot g_r/2)}{Z_r} \qquad \text{Formula (4)}$$

In this case, if the characteristic impedance $Z_t$ of the branch line 3 and the capacitance C of the capacitor 6 are set as in the following formula (5) so as to make matching between the impedance $2Z_{cc}$ of the load 11 and the impedance as viewed toward the output terminal 2 from the connecting point between the branch line 3 and the transmission line 4, all the high-frequency signals inputted to the output terminals 2 are supplied to the load 11 without being reflected.

$$Z_t = \sqrt{2Z_{oc}Re(Z_{re2})}\ \ 2Im\left[\frac{Z_{re2}}{Z_t^2}\right] + \omega C = 0 \text{ and,} \qquad \text{Formula (5)}$$

$$Z_{re2} = Z_2\frac{Z_{red} + jZ_2\tan\theta_2}{Z_2 + jZ_{red}\tan\theta_2}$$

$$Z_{red} = \frac{Z_{od}}{Y_{re1} + Z_{od} + 1}$$

$$Y_{re1} = \frac{1}{Z_1}\cdot\frac{Z_1 + jZ_{re} + \tan\theta_1}{Z_{re} + jZ_1 + \tan\theta_1}$$

Further, when the high-frequency signal is inputted to the input terminal 1, the operation is the same as in the even mode.

Based on the operational principles of the odd and even modes, it can be comprehended that the I/O reflections are restrained, and the isolation between the output terminals 2 is ensured.

In the configuration described above, the I/O matching condition taking the electrical length of the isolation resistor into consideration, and hence there is produced such an effect that even when the resistor length is a value that can not be ignored as compared with the wavelength of the high-frequency signal in use, the I/O reflections are reduced, and besides the isolation between the output terminals 2 can be ensured.

A further effect is that the isolation resistor can be connected even by use of the connection line 9 in the case of the output terminals 2 being far apart from each other. A still further effect is that the matching for the input and output can be made owing to the functions of the transmission line 4 and of the connection line 9, and it is therefore feasible to freely select the resistance values of the isolation resistor 5 and the outside impedance, which are connected to the input terminal 1 and the output terminals 2.

Embodiment 6

Figure 10:
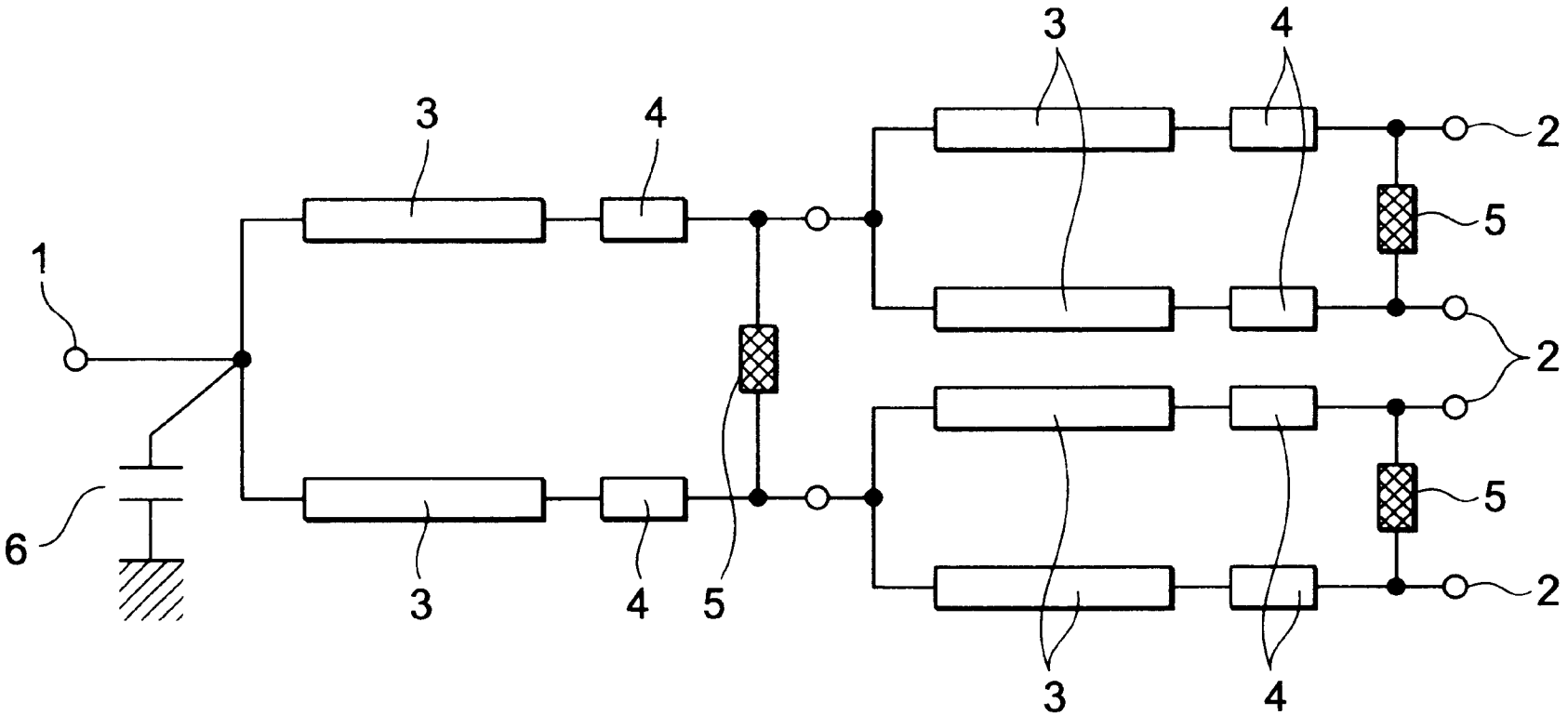
FIG. 10 is a diagram showing a circuit configuration of the power divider/combiner in accordance with an embodiment 6 of the present invention.
Figure 11:
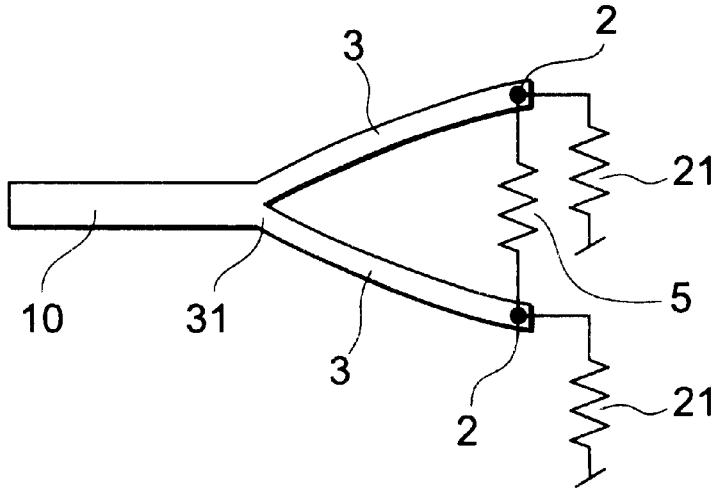
FIG. 11 PRIOR ART
FIG. 11 is a diagram showing a circuit configuration of a power divider/combiner in the prior art.
Figure 12:
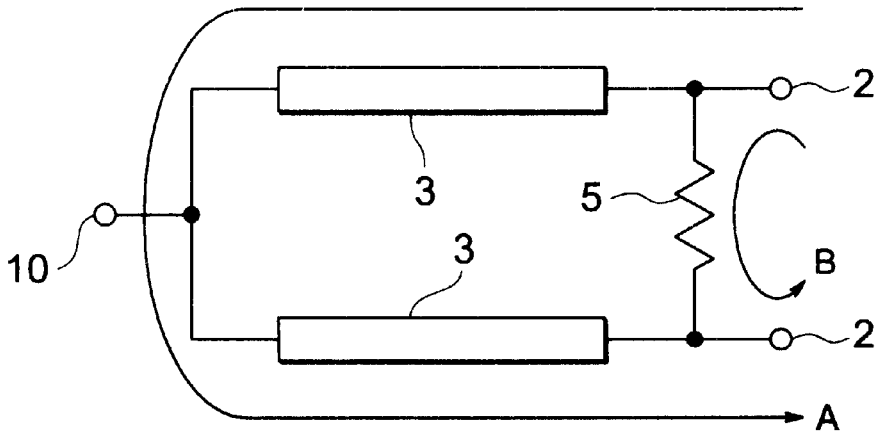
FIG. 12 PRIOR ART
FIG. 12 is a diagram showing an operation of the power divider/combiner in the prior art.

FIG. 10 is a diagram showing a circuit configuration of the power divider/combiner in an embodiment 6 of the present invention. This power divider/combiner is structured by connecting three modules of 2-way power dividers/combiners connected in a multipoint extension (as drawn in a tournament) in order to actualize 4-way power division/combination, wherein a capacitor 6 with its one end being connected to only the input terminal 1 is provided.

In this power divider/combiner also, when viewed from the input terminal 1, the isolation resistors 5 having the electrical length function as a open stub with respect to the line of the signal flowing to the output terminals 2 from the input terminal 1. Such being the case, a susceptance possessed by this resistor is compensated by the capacitor 6, thereby enhancing the reflection characteristic as viewed from the input terminal 1. In this configuration, the 2-way power divider/combiner disposed at the second stage is not required to be provided with the capacitor, resulting in such an effect that the circuit can be downsized.

What is claimed is:

1. A power divider/combiner, comprising:

an input terminal;

two output terminals;

two branch lines each connecting said input terminal and said output terminal and having a line length that is ¼ of a set wavelength or an integer multiple of half the set wavelength and ¼ of the set wavelength;

an isolation resistor connected between said output terminals; and a transmission line interposed between each of said output terminals and said branch lines, each transmission line having a length selectively determined based on a difference in potential at said output terminals.

2. A power divider/combiner according to claim 1, further comprising a capacitance element having one end connected to said input terminal and the other end grounded.

3. A power divider/combiner according to claim 1, further comprising a open stub connected to said input terminal.

4. A power divider/combiner according to claim 1, further comprising a low impedance line interposed between said input terminal and a connecting point between said two branch lines.

5. A power divider/combiner according to claim 2, wherein said isolation resistor is connected between said output terminals through a connection line.

6. A power divider/combiner, comprising:

(a) a first power divider/combiner including:

a first input terminal;

two first output terminals;

two first branch lines each connecting said first input terminal and one of said first output terminals and having a line length that is ¼ of a set wavelength or an integer multiple of half the set a wavelength and ¼ of the set wavelength;

a first isolation resistor connected to between said first output terminals;

a first transmission line interposed between each of said first output terminals and said first branch lines; and a capacitance element having its one end connected to said first input terminal and the other end grounded;

(b) a second power divider/combiner including:

a second input terminal connected to one of said first output terminals;

two second output terminals;

two second branch lines each connecting said second input terminal and one of said second output terminals and having a line length that is ¼ of a set wavelength or an integer multiple of half the set wavelength and ¼ of the set wavelength;

a second isolation resistor connected to between said second output terminals; and a second transmission line interposed between each of said second output terminals and said second branch lines; and (c) a third power divider/combiner including:

a third input terminal connected to said other first output terminal;

two third output terminals;

two third branch lines each connecting said third input terminal and one of said third output terminals and having a line length that is ¼ of a set wavelength or an integer multiple of half the set wavelength and ¼ of the set wavelength;

a third isolation resistor connected to between said third output terminals; and a third transmission line interposed between each of said third output terminals and said third branch lines.

7. A power divider/combiner comprising:

an input terminal;

two output terminals;

two branch lines each connecting the input terminal and the two output terminals and having a line length of ¼ of a set wavelength or an integer multiple of half the set wavelength and ¼ of the set wavelength;

an isolation resistor connected between the two output terminals, the isolation resistor having a predetermined electrical length; and a transmission line interposed between each of the output terminals and the branch lines, each transmission line having a length selectively determined based on a difference in potential at said output terminals.

8. A power divider/combiner, comprising:

an input terminal;

two output terminals;

two branch lines each connecting said input terminal and said output terminal and having a line length that is ¼ of a set wavelength or an integer multiple of half the set wavelength and ¼ of the set wavelength;

an isolation resistor directly connected between said output terminals; and a transmission line interposed between each of said output terminals and said branch lines and having a line length that is shorter than ¼ of the set wavelength.

* * * * *